US008382915B2

(12) United States Patent
Shook

(10) Patent No.: US 8,382,915 B2
(45) Date of Patent: Feb. 26, 2013

(54) CONCRETE MIXER DRUM CLEANER

(75) Inventor: Forrest A. Shook, Fenton, MI (US)

(73) Assignee: NLB Corp., Wixom, MI (US)

( * ) Notice: Subject to any disclaimer, the term of this patent is extended or adjusted under 35 U.S.C. 154(b) by 2055 days.

(21) Appl. No.: 11/452,552

(22) Filed: Jun. 14, 2006

(65) Prior Publication Data

US 2006/0289037 A1 Dec. 28, 2006

Related U.S. Application Data

(60) Provisional application No. 60/692,811, filed on Jun. 22, 2005.

(51) Int. Cl.
*B08B 3/02* (2006.01)

(52) U.S. Cl. ..... 134/167 R; 134/166 R; 134/168 R; 134/172

(58) Field of Classification Search ..... 134/166 R, 134/167 R, 168 R, 172
See application file for complete search history.

(56) References Cited

U.S. PATENT DOCUMENTS

| | | | | |
|---|---|---|---|---|
| 3,460,988 | A * | 8/1969 | Kennedy, Jr. et al. | 134/1 |
| 4,941,491 | A * | 7/1990 | Goerss et al. | 134/111 |
| 6,213,135 | B1 * | 4/2001 | Moulder | 134/167 R |
| 6,418,948 | B1 * | 7/2002 | Harmon | 134/168 R |
| 2002/0144714 | A1 * | 10/2002 | McCasker | 134/22.18 |
| 2005/0005955 | A1 * | 1/2005 | Robinson | 134/166 R |

* cited by examiner

*Primary Examiner* — Michael Barr
*Assistant Examiner* — Benjamin L Osterhout
(74) *Attorney, Agent, or Firm* — Carlson, Gaskey & Olds PC

(57) ABSTRACT

The present invention is a concrete mixer drum cleaner system. The system has a multi-axis spray head mounted to a lance. One of the spray head's axes of rotation is coaxial with the lance. An operator uses the lance to position the spray cleaner head within the interior of a concrete mixer drum.

17 Claims, 2 Drawing Sheets

CONCRETE MIXER DRUM CLEANER

CROSS REFERENCE TO RELATED APPLICATION

The application claims priority to U.S. Provisional Application No. 60/692,811 which was filed on Jun. 22, 2005.

BACKGROUND OF THE INVENTION

The present invention relates generally to a redi-mix concrete mixer drum cleaner. More particularly, this invention relates to a rotating spray cleaner mounted to a telescoping lance.

Concrete trucks transport liquid concrete in rotatable mixer drums. Helical baffles line the interior of the mixer drum and move the liquid concrete fore and aft within the mixer drum when the mixer drum rotates. The direction of the liquid concrete depends on the rotational direction of the mixer drum. After removing a load of liquid concrete, residual concrete may remain in the mixer drum of the concrete truck, especially on or near the helical baffles.

The residual concrete eventually cures and hardens within the mixer drum. Over time, the build-up of hardened residual concrete increases the apparent weight of the mixer drum, and lowers the mixer drum's liquid concrete capacity. In addition, the hardened residual concrete, especially near the helical baffles, may interfere with unloading liquid concrete from the mixer drum. In some cases, removing the hardened concrete may require that an operator actually enters the interior of the mixer drum and physically chips the hardened residual concrete from the helical baffles. Typically, the operator uses a jack-hammer to remove the hardened residual concrete producing significant dust and other hazards. Accordingly, it is desirable to remove residual concrete from the mixer drum prior to the residual concrete hardening.

Many operators today rely on wand-mounted pressurized spray devices to remove residual concrete from the inside of the mixer drum. These devices are inflexible in their design and in their spray pattern, and they do not always effectively clean residual concrete from the concrete mixer drum. More specifically, the wand-mounted pressurized spray devices may not effectively clean all sides of the helical baffles inside the mixer drum. In addition, the limited spray pattern of existing devices may require the mixer drum to rotate while spraying the interior of the mixer drum to increase the coverage area.

It would be desirable to provide a pressurized spray to the interior of the mixer drum ensuring thorough liquid and solid residual concrete removal.

If would be further desirable to provide a pressurized spray to clean liquid and solid concrete from the interior of the rotating or stationary mixer drum.

SUMMARY OF THE INVENTION

The present invention is a redi-mix concrete mixer drum cleaner system. The system has a multi-axis spray head mounted to a lance. One of the spray head's axes of rotation is coaxial with the lance. An operator uses the lance, typically a telescoping lance, to position the spray cleaner head within the concrete mixer drum. In one example, the telescoping lance is a programmable lance, which may be programmed to move through a series of desired movements. The program may continuously move the telescoping lance, or may cause the telescoping lance to remain in a certain position for an extended period of time. A worker of ordinary skill in the art would be able to develop an appropriate program. For example, an operator may use a programmable logic controller to control the movement of the telescoping lance.

Pressurized fluid communicates from a source and is discharged from the spray head. In so doing, the pressurized fluid induces rotation of the spray head. The rotating spray head may be partially protected by a protective barrier. In addition to protecting the rotating spray head from being damaged inside the mixer drum, the protective barrier also prevents the rotating spray head from damaging the interior of the mixer drum.

The present invention also includes a spray cleaner head rotatably mounted to a lance. The spray cleaner head includes at least one spray nozzle. The spray nozzle's axis of rotation is transverse to the spray cleaner head's axis of rotation. In this embodiment, pressurized fluid exiting the spray nozzle induces rotation of the spray cleaner head and associated nozzle.

DETAILED DESCRIPTION OF THE PREFFERRED EMBODIMENT

Figure 1:
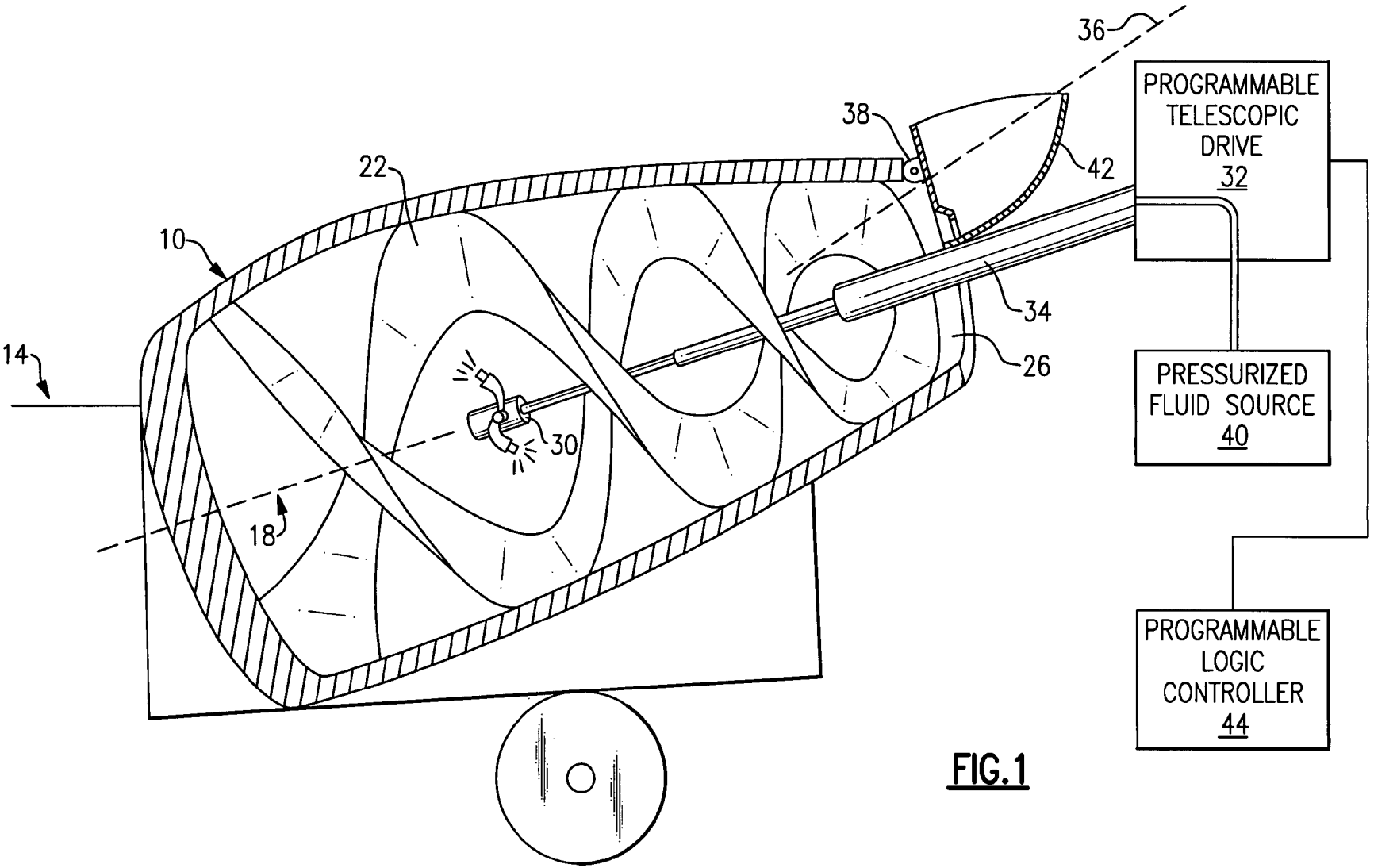
FIG. 1 is a cross sectional view of a concrete mixer drum including the lance mounted rotating spray head of this invention.

As shown in FIG. 1, the redi-mix concrete mixer drum 10 rotatably mounts to a concrete truck 14. As known, the concrete mixer drum 10 rotates about axis 18 to mix the liquid concrete and to slow the concrete hardening process.

The mixer drum 10 may include a set of twin helical baffles 22. When the mixer drum 10 rotates in a first direction, the helical baffles 22 move the liquid and solid concrete away from a mixer drum opening 26. When the mixer drum 10 rotates in a second opposite direction, the helical baffles 22 move the liquid and solid concrete towards the mixer drum opening 26. The mixer drum 10 rotates in the second direction to remove liquid and solid concrete from the mixer drum 10.

After removing a load of concrete from the mixer drum 10, some residual concrete may remain. Pressurized liquid sprayed from the rotating spray cleaner 30 removes residual concrete from the inside of the drum. The rotating spray cleaner 30 is mounted to a telescoping lance 34, which adjusts to accommodate to the size of the mixer drum 10, and to direct the rotating spray cleaner 30 to desired areas of the mixer drum 10. A programmable telescopic drive 32, such as a hydraulic cylinder or a worm gear, adjusts the length of the lance 34.

The telescoping lance 34 may be programmed to move through a series of desired movements. In one example, the operator, using a Programmable Logic Controller (PLC) 44 or similar control mechanism, automates the movement of the telescoping lance 34. The PLC 44 communicates with the telescopic drive 32 to move the telescoping lance 34 into a desired position or series of desired positions. In so doing, an operator may develop a preferred cleaning cycle program for cleaning the interior of the mixer drum 10. Using the PLC 44 to control the position of the telescoping lance 34 enables the operator to recall the program for additional cleanings at a later time. The PLC 44 may direct the telescopic drive 32 to continuously move the telescoping lance 34, or to remain in a certain position for an extended period of time, such as a position that focuses the rotating spray cleaner 30 on a known area of residual concrete build-up. A worker of ordinary skill in the art having the benefit of this disclosure may be able to develop other types of programs capable of controlling the position of the telescoping lance 34.

When the mixer drum 10 is equipped with a hopper 42, an operator may need to rotate the hopper 42 about a hinged pivot 38 to provide access for the lance 34 along line 36. Although described as entering the interior of the mixer drum 10 along line 36, those skilled in the art and having the benefit of this disclosure may be able to identify other areas of the mixer drum 10 suitable for providing rotating spray cleaner 30 access, for example, an access opening through other areas of the mixer drum 10. The lance 34 may also access the interior of the mixer drum 10 through the portion of the mixer drum opening 26 below the hopper 42.

Figure 2:
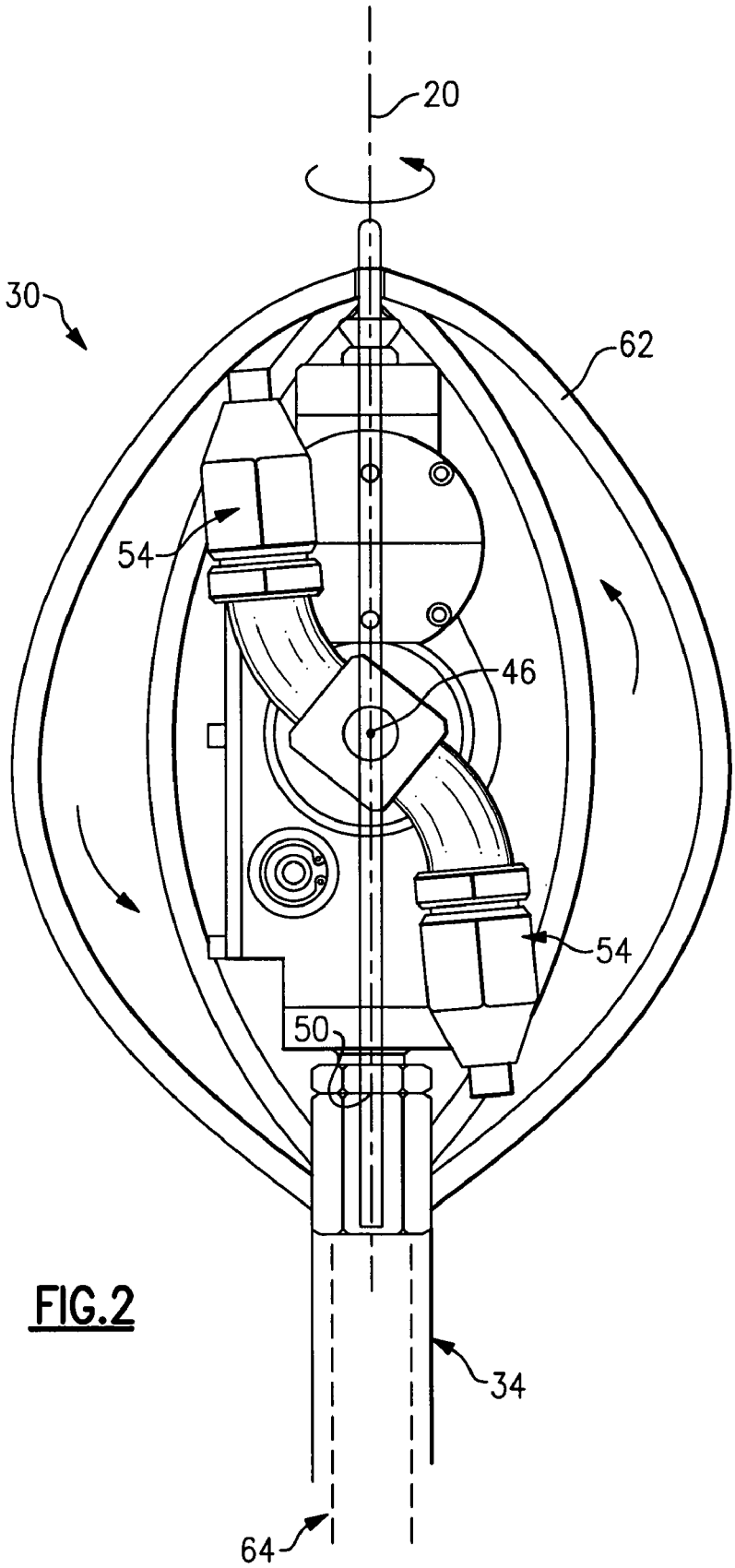
FIG. 2 is a perspective view of the rotating sprayer with a protective cage.

FIG. 2 illustrates in more detail the rotating spray cleaner 30 mounted to the lance 34. As shown, the rotating spray cleaner 30 includes a pair of nozzles 54. The rotating spray cleaner 30 rotates about an axis of rotation 20 that is generally coaxial with the lance 34. The nozzles 54 rotate about a second axis of rotation 46, transverse to axis of rotation 20 of the rotating spray cleaner 30. Axis of rotation 46 is substantially transverse to the axis of rotation 20. An example of a suitable rotating spray cleaner 30 is available from the assignee of this application, (NLB Corporation) as model number NLB 3750.

Although the pair of nozzles 54 are described as having an axis of rotation substantially transverse to the rotating spray cleaner 30 axis of rotation 20, it should be understood that a person skilled in the art and having the benefit of this disclosure may determine other possible axial relationships falling within the scope of this invention.

The rotating spray cleaner 30 rotates when a high-pressure fluid, such as water, enters the rotating spray cleaner 30 at an inlet 50 and exits through the nozzles 54. The pressure of the fluid may range from 1,000-40,000 psi. Preferably, an operator adjusts the pressure of the fluid to remove residual concrete of differing consistencies. For instance, when residual concrete is partly hardened, a high-pressure fluid may be used. When residual concrete is substantially liquid, a lower-pressure fluid may be used.

The fluid travels from a pressurized fluid supply 40 through a passage 64, along the lance 34, entering the rotating spray cleaner at the inlet 50. The rotating spray cleaner 30 and the adjustable length of the lance 34 direct pressurized fluid to desired areas on the interior of the mixer drum 10. The rotating spray cleaner 30 and the telescoping lance 34 can direct pressurized spray to all sides of the helical baffles 22. As the rotating spray cleaner 30 rotates, the mixer drum 10 may remain stationary while the pressurized fluid is directed at the interior of the mixer drum 10. Alternatively, the mixer drum 10 may rotate as the rotating spray cleaner 30 directs pressurized fluid at the interior. When rotating, the helical baffles 22 may move the mixture of fluid and residual concrete toward the mixer drum opening 26.

The rotating spray cleaner 30 may be fitted with a protective cage 62 to prevent rotating portions of the spray cleaner 30 from contacting the helical baffles 22 and other areas of the mixer drum 10. The protective cage 62 includes a plurality of protective bars spaced to provide a barrier between the rotating portions of the spray cleaner 30 and the mixer drum 10. Although the example protective cage 62 shown in FIG. 2 uses five protective bars, any number may be used. In this example, the protective cage 62 does not rotate relative to the telescoping lance 34. Another example of a suitable cage 62 is available from the assignee of this application, (NLB Corporation) as model number DA8141.

A preferred embodiment of this invention has been disclosed, however, a worker of ordinary skill in this art will recognize that certain modifications come within the scope of this invention. For that reason, the following claims should be studied to determine the true scope and content of this invention.

The invention claimed is:

1. A concrete mixer drum cleaner system, comprising:
a spray cleaner head having at least two axes of rotation;
a lance operative to position said spray cleaner head; and
wherein one of said at least two axes of rotation has a component that is coaxial with said lance, wherein said spray cleaner head includes at least one spray outlet for discharging a pressurized fluid, wherein discharging said pressurized fluid induces a rotation of said spray cleaner head relative to said lance.

2. The cleaner system of claim 1, wherein one of said at least two axes of rotation is coaxial with said lance.

3. The cleaner system of claim 1, wherein discharging said pressurized fluid induces a rotation of said at least one spray outlet relative to at least one portion of said spray cleaner head.

4. The cleaner system of claim 1, wherein said lance is a programmable telescoping lance.

5. The cleaner system of claim 1, including a protective barrier operative to protect said spray cleaner head.

6. The cleaner system of claim 1, wherein the lance is configured to position said spray cleaner head in a non-vertical position.

7. The cleaner system of claim 1, wherein the spray cleaner head is rigidly attached to said lance.

8. The cleaner system of claim 1, wherein the lance translates along a non-vertical axis.

9. The cleaner system of claim 1, wherein the spray cleaner head is configured to communicate a single type of fluid.

10. A concrete mixer drum cleaner system, comprising:
a spray cleaner head rotatably mounted to a lance, said spray cleaner head rotatable relative to said lance about a non-vertical axis of said lance;
at least one spray nozzle rotatably mounted to said spray cleaner head; and
a barrier for protecting said spray cleaner head, wherein an axis of rotation of said at least one spray nozzle is substantially transverse to an axis of rotation of said spray cleaner head.

11. The cleaner system of claim 10, wherein said spray nozzle includes a spray outlet for discharging a fluid.

12. The cleaner system of claim 11, wherein said spray outlet discharges said fluid transverse to said spray nozzle axis of rotation.

13. The cleaner system of claim 11, wherein discharging said fluid induces rotation of said at least one spray nozzle.

14. The cleaner system of claim 11, wherein discharging said fluid induces rotation of said spray cleaner head.

15. The cleaner system of claim 10, wherein said lance is a programmable telescoping lance.

16. The cleaner system of claim 10, wherein said lance is configured to position said spray cleaner head in a non-vertical position.

17. The cleaner system of claim 10, wherein one of said axis of rotation of said at least one spray nozzle or said axis of rotation of said spray cleaner is non-vertical and coaxial with said lance.

* * * * *